US009487001B2

(12) United States Patent
Nishi et al.

(10) Patent No.: US 9,487,001 B2
(45) Date of Patent: Nov. 8, 2016

(54) INKJET HEAD AND INKJET RECORDING DEVICE

(71) Applicant: KONICA MINOLTA, INC., Chiyoda-ku (JP)

(72) Inventors: Yasuo Nishi, Hachioji (JP); Kusunoki Higashino, Osaka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/917,237

(22) PCT Filed: Sep. 4, 2014

(86) PCT No.: PCT/JP2014/073302

§ 371 (c)(1),
(2) Date: Mar. 7, 2016

(87) PCT Pub. No.: WO2015/033993

PCT Pub. Date: Mar. 12, 2015

(65) Prior Publication Data

US 2016/0193830 A1 Jul. 7, 2016

(30) Foreign Application Priority Data

Sep. 6, 2013 (JP) ..... 2013-184892

(51) Int. Cl.
*B41J 2/045* (2006.01)

(52) U.S. Cl.
CPC ..... *B41J 2/04588* (2013.01); *B41J 2/04581* (2013.01)

(58) Field of Classification Search
CPC ..... B41J 2/04581; B41J 2/04588; B41J 2/04596; B41J 2/0458; B41J 2002/14306; B41J 2/16526
See application file for complete search history.

(56) References Cited

U.S. PATENT DOCUMENTS

2002/0126167 A1* 9/2002 Kimura ..... B41J 2/04581 347/11
2010/0053249 A1* 3/2010 Matsushita ..... B41J 2/04526 347/14

FOREIGN PATENT DOCUMENTS

| | | |
|---|---|---|
| JP | 9-141851 | 6/1997 |
| JP | 2004-136655 | 5/2004 |
| JP | 2007-62091 | 3/2007 |
| JP | 2007-137054 | 6/2007 |
| JP | 2009-533253 | 9/2009 |
| WO | WO 2009/107552 | 9/2009 |

* cited by examiner

*Primary Examiner* — Thinh Nguyen
(74) *Attorney, Agent, or Firm* — Cozen O'Connor

(57) ABSTRACT

An inkjet head comprising ink flow paths each including a nozzle in communication with a pressure chamber. Pressurizing sections vary pressure on the ink in the respective pressure chambers. Each of the ink flow paths has a natural frequency of a first-order mode and the ink and has a natural frequency of a second-order mode which is higher than the natural frequency of the first-order mode. Each of the pressurizing sections varies the pressure on the ink for a predetermined time corresponding to the natural frequency of the first-order mode, so that a predetermined volume of ink is discharged when a shift of a fluid level of the ink due to pressure oscillation of the second-order mode is superposed on a shift of a fluid level of the ink due to pressure oscillation of the first-order mode.

10 Claims, 10 Drawing Sheets

*FIG. 7*

| | | | |
|---|---|---|---|
| INLET | LENGTH | [μm] | 630 |
| | WIDTH | [μm] | 40 |
| | HEIGHT | [μm] | 120 |
| PRESSURE CHAMBER | HEIGHT | [μm] | 120 |
| | DIAMETER | [μm] | 370 |
| DIAPHRAGM | THICKNESS | [μm] | 30 |
| PIEZOELECTRIC MEMBER | d31 = 330 | | |
| | THICKNESS | [μm] | 60 |
| | DIAMETER | [μm] | 330 |
| COMMUNICATING HOLE | LENGTH | [μm] | 155 |
| | DIAMETER | [μm] | 67 − 100 |
| UPPER NOZZLE PORTION | LENGTH | [μm] | 210 |
| | DIAMETER | [μm] | 70 |
| NOZZLE | LENGTH | [μm] | 5.0 |
| | DIAMETER | [μm] | 5.0 |

FIG.12

| | | | SETTING 1 | SETTING 2 | SETTING 3 |
|---|---|---|---|---|---|
| COMMUNICATING HOLE | LENGTH | [μm] | 150 | 200 | 250 |
| | DIAMETER | [μm] | 70 – 110 | 70 – 110 | 70 – 110 |
| UPPER NOZZLE PORTION | LENGTH | [μm] | 200 | 250 | 300 |
| | DIAMETER | [μm] | 80 | 80 | 80 |
| FREQUENCY OF SECOND-ORDER MODE | | [kHz] | 816 | 683 | 629 |
| FLYING CHARACTERISTICS AT 3 cp AND 30 V | VOLUME | [pL] | 0.100 | 0.118 | 0.130 |
| | VELOCITY | [m/s] | 3.00 | 3.20 | 3.35 |

FIG.13

| | | | SETTING 4 | SETTING 5 | SETTING 6 | SETTING 1 | SETTING 7 |
|---|---|---|---|---|---|---|---|
| INLET | LENGTH | [μm] | 200 | 300 | 400 | 600 | 800 |
| | WIDTH | [μm] | 30 | 30 | 30 | 30 | 30 |
| | HEIGHT | [μm] | 130 | 130 | 130 | 130 | 130 |
| FREQUENCY OF SECOND-ORDER MODE | | [kHz] | 814 | 810 | 802 | 816 | 814 |
| FLYING CHARACTERISTICS AT 3 cp AND 30 V | VOLUME | [pL] | 0.089 | 0.095 | 0.098 | 0.100 | 0.101 |
| | VELOCITY | [m/s] | 2.80 | 2.90 | 3.00 | 3.00 | 3.10 |

FIG.14

| | | | SETTING 8 | SETTING 1 | SETTING 9 |
|---|---|---|---|---|---|
| NOZZLE | LENGTH | [μm] | 5.0 | 5.0 | 5.0 |
| | DIAMETER | [μm] | 4.8 | 5.0 | 5.2 |
| FREQUENCY OF SECOND-ORDER MODE | | [kHz] | 812 | 816 | 820 |
| FLYING CHARACTERISTICS AT 3 cp AND 30 V | VOLUME | [pL] | 0.089 | 0.100 | 0.113 |
| | VELOCITY | [m/s] | 2.60 | 3.00 | 3.40 |

INKJET HEAD AND INKJET RECORDING DEVICE

RELATED APPLICATIONS

This is a U.S National Phase Application under 35 USC 371 of International Application PCT/JP2014/073302 filed on Sep. 4, 2014.

This application claims the priority of Japanese application No. 2013-184892 filed Sep. 6, 2013, the entire content of which is hereby incorporated by reference.

TECHNICAL FIELD

The present invention relates to an inkjet head and an inkjet recording device.

BACKGROUND ART

A typical inkjet recording device includes an inkjet head that discharges minute droplets of ink to form an image on a recording medium. The inkjet head includes nozzles aligned at a predetermined pitch and discharging ink at controlled timings depending on the resolution of the image to be formed and/or the rate of image formation.

Such an inkjet head is typically of a piezoelectric or thermal inkjet type that discharges ink from the tips of the nozzles through pressurization of the ink in the ink flow paths. An increase in image resolution has resulted in a decrease in the volume of ink per discharge. The discharge of such a minute volume of ink requires a decrease in dimension of the nozzle orifices and the time of pressurization. Unfortunately, a decrease in dimension of the cross-section of the nozzles orifices enhances the influence of friction occurring between the ink and nozzle walls and viscosity and surface tension of the ink, which prevents the ink in the ink flow paths from stably separating and being discharged as droplets having a desired volume.

PTL 1 discloses an electrostatic attraction type inkjet head that applies a voltage to the tips of minute nozzles to attract charged ink and discharge the ink in minute volumes.

The ink is supplied to the nozzles from a common ink chamber for the nozzles through ink leading paths (inlets) for the nozzles and pressure chambers provided for pressurization of the ink. The ink pressure varies depending on a natural frequency (resonant frequency) determined in accordance with the dimensions of the inlets, pressure chambers, and nozzles (length in particular), and the density and viscosity of the ink. The fluid level (meniscus) of the ink shifts inward or outward from the orifice edges of the nozzles in accordance with the cycle of natural frequency. The natural oscillation includes an inherent mode (first-order mode) oscillation on the overall structure of the inlets, pressure chambers, and nozzles, and one or more other inherent modes on a part of the structure, depending on the differences in structure (shape) of the inlets, pressure chambers, and nozzles.

Among the inherent modes, the mode of a portion including the nozzles involves the extrusion of ink at the orifice edges of the nozzles and is a second-order mode having a frequency higher than the natural frequency of the first-order mode. PTL 2 discloses a technique of applying pressure to ink in pressure chambers at a cycle corresponding to the natural frequency of the second-order mode, to reduce the time of ink discharge and thereby the volume of the discharged ink.

PRIOR ART LITERATURES

Patent Literatures

[PTL 1] Japanese Unexamined Patent Application Publication No. 2004-136655

[PTL 2] WO2009/107552

DISCLOSURE OF INVENTION

Problems to be Solved by the Invention

The ink should be charged in order to attract the ink to an electric field. This limits the type of applicable inks. This also requires a configuration for voltage application near the orifice edges of the nozzles, which results in a complicated structure. The pulse width corresponding to the natural frequency of the second-order mode is significantly smaller than the width of typically applied pulses. The precise application of pulses having such a small width requires a complicated configuration and/or causes an increase in the dimensions of the circuits.

An object of the present invention is to provide an inkjet head and an inkjet recording device that have an increased range of applicable inks and readily decrease the volume of ink per discharge without an increase in the dimensions of the configuration and complicated control involving ink discharge.

Means for Solving Problems

In order to achieve the above-described object, the present invention recited in claim 1 is an inkjet head including: ink flow paths each including a nozzle from which ink is to be discharged, and a pressure chamber in communication with the nozzle, the ink flow path allowing the ink from an ink chamber to be supplied to the nozzle; and pressurizing sections to vary pressure on the ink in the respective pressure chambers, wherein each of the ink flow paths has a natural frequency of a first-order mode depending on a combination of the entire ink flow path and the ink and has a natural frequency of a second-order mode depending on a combination of a part of the ink flow path and the ink, wherein the part includes the nozzle and wherein the natural frequency of the second-order mode is higher than the natural frequency of the first-order mode; and each of the pressurizing sections varies the pressure on the ink for a predetermined time corresponding to the natural frequency of the first-order mode, so that a predetermined volume of the ink is discharged at at least one of times when a shift of a fluid level of the ink due to pressure oscillation of the ink at the natural frequency of the second-order mode is superposed on a shift of a fluid level of the ink due to pressure oscillation of the ink at the natural frequency of the first-order mode.

The present invention recited in claim 2 is the inkjet head according to claim 1, wherein the pressurizing sections keep the pressure on the ink in an increased state for the predetermined time.

The present invention recited in claim 3 is the inkjet head according to claim 1 or 2, wherein the nozzles included in the respective ink flow paths each have such a diameter that prevents the ink from being discharged by the shift of the fluid level of the ink due to the pressure oscillation of the ink at the natural frequency of the first-order mode alone.

The present invention recited in claim 4 is the inkjet head according to any one of claims 1 to 3, wherein a Q value relating to the pressure oscillation of the ink at the natural frequency of the first-order mode is less than 1.

The present invention recited in claim 5 is the inkjet head according to any one of claims 1 to 4, wherein the natural frequency of the second-order mode of each of the ink flow paths is at least four times higher than the natural frequency of the first-order mode of each of the ink flow paths.

The present invention recited in claim 6 is the inkjet head according to any one of claims 1 to 5, wherein a variation in the pressure on the ink produced by each of the pressurizing sections is in a form of a substantially square wave pulse having a rising time and a falling time each shorter than one cycle of the natural frequency of the second-order mode.

The present invention recited in claim 7 is the inkjet head according to any one of claims 1 to 6, wherein the pressurizing sections each include a piezoelectric member, wherein the piezoelectric member is deformed in response to a voltage applied to the piezoelectric member, thereby varying the pressure on the ink.

The present invention recited in claim 8 is an inkjet recording device including: the inkjet head according to anyone of claims 1 to 7; and a control section that controls an operation of the inkjet head, wherein the control section operates the pressurizing sections at predetermined intervals for ink discharge to vary the pressure on the ink in the respective pressure chambers in communication with the respective nozzles from which the ink is to be discharged.

Effects of the Invention

The present invention is advantageous in that it has an increased range of applicable inks and can readily decrease the volume of ink per discharge from nozzles without an increase in the dimensions of the configuration and complicated control involving ink discharge.

BRIEF DESCRIPTION OF DRAWINGS

FIG. 7 is a table showing the dimensions of the components of the head chip used for calculation.

FIG. 12 is a table showing the influence of the length of a second-order mode path on the discharge of ink droplets.

FIG. 13 is a table showing the influence of the length of inlets on the discharge of ink droplets.

FIG. 14 is a table showing the influence of the diameter of nozzles on the discharge of ink droplets.

EMBODIMENT TO CARRY OUT THE INVENTION

Embodiments of the present invention will now be described with reference to the accompanying drawings.

Figure 1:
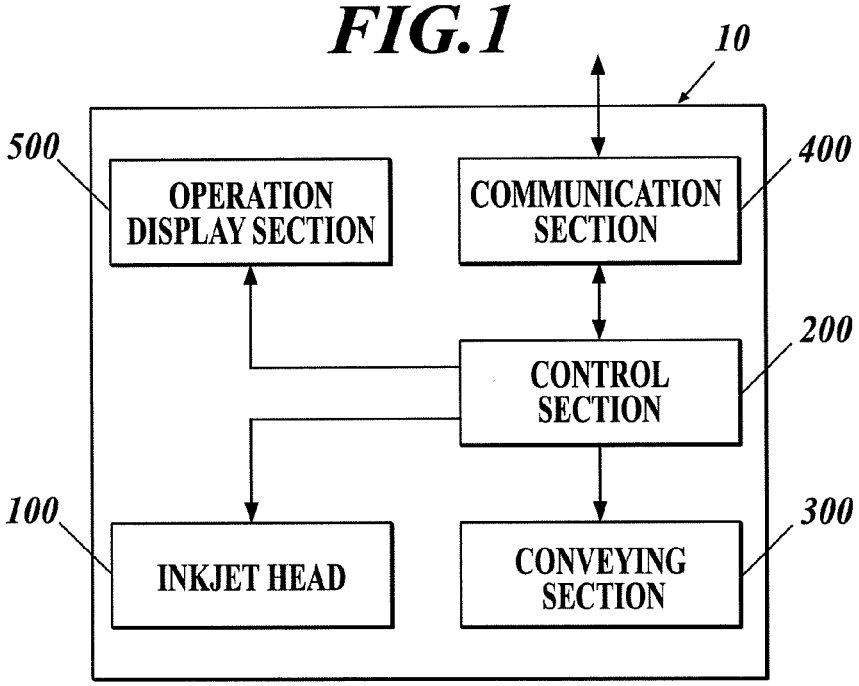
FIG. 1 is a block diagram illustrating the overall configuration of an inkjet recording device according to an embodiment.

FIG. 1 is a block diagram illustrating the overall configuration of an inkjet recording device 10 according to this embodiment.

The inkjet recording device 10 includes an inkjet head 100, a control section 200, a conveying section 300, a communication section 400, and an operation display section 500.

The control section 200 includes a CPU (central processing unit), a RAM (random access memory), and an storage unit, and comprehensively controls the operation of the inkjet recording device 10 based on print jobs sent from external units or the operation display section 500.

The conveying section 300 moves recording media to a position for image formation and ejects the recording media from the position in sequence. The conveying section 300, for example, includes a conveying belt, a motor that moves the conveying belt, a paper feeder that supplies the recording media, and a paper tray that stores ejected recording media.

The communication section 400 is a communication interface to perform data communication with an external print servers) and/or an external computer terminal (s). The communication section 400 is responsible for wired or wireless LAN (local area network) connection and USB connection.

The operation display section 500 receives input operations by a user and displays various menus and the status of the inkjet recording device 10. The operation display section 500, for example, is in the form of a touch panel that includes a liquid crystal display and a touch sensor. The operation display section 500 may also include a push button switch, operating keys, and status display lamps.

The inkjet head 100 operates in response to control signals from the control section 200 to form an image on a recording medium supplied from the paper feeder of the conveying section 300.

Figure 2:
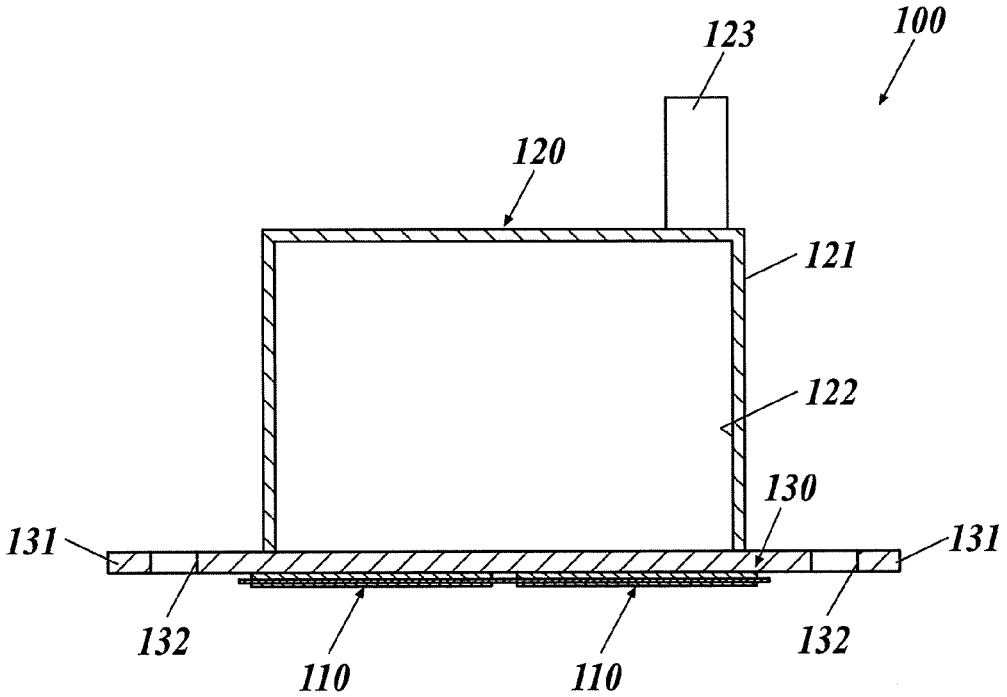
FIG. 2 is a cross-sectional side view illustrating the structure of an inkjet head according to an embodiment of the present invention.

FIG. 2 is a cross-sectional side view illustrating the inkjet head 100 according this embodiment.

The inkjet head 100 according to this embodiment includes a head chip 110, an ink supply section 120, and a frame 130.

The ink supply section 120 includes a casing 121 having an ink chamber 122 therein. The ink supply section 120 ejects ink supplied from an external unit via an ink supply port 123 that connects the interior and the exterior of the casing 121, to the head chip 110.

The frame 130 is composed of a substantially flat member and combined with the head chip 110 and the ink supply section 120. The ink supply section 120 is disposed on one face (upper face) of the frame 130, and the head chip 110 is disposed on the other face (lower face) of the frame 130 remote from the ink supply section 120. The frame 130 has a space (not shown) disposed between the head chip 110 and the ink supply section 120 that connects the head chip 110 and the ink supply section 120.

Two ends of the frame 130 are provided with projections 131, which are each provided with a hole 132. The frame 130 is fixed at a predetermined position on the inkjet recording device 10 with fixing members such as screws or bolts installed through the holes 132.

The head chip 110 is composed of a plate having multiple nozzles. The head chip 110 discharges ink droplets from the nozzles at a predetermined timing in response to a control signal from the control section 200. The ink droplets land on the recording medium conveyed to a position facing the relevant nozzles. Each ink supply section 120 may be provided with two or more head chips 110 (for example, two chips in this case).

Figure 3A:
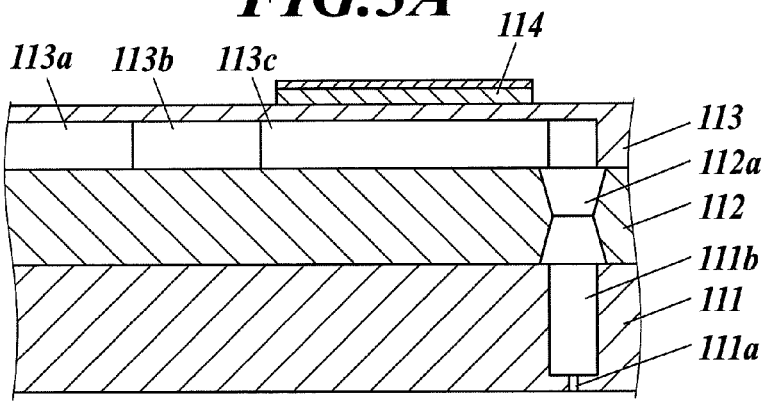
FIG. 3A is a cross-sectional side view of a portion of the head chip relating to one nozzle.
Figure 3B:
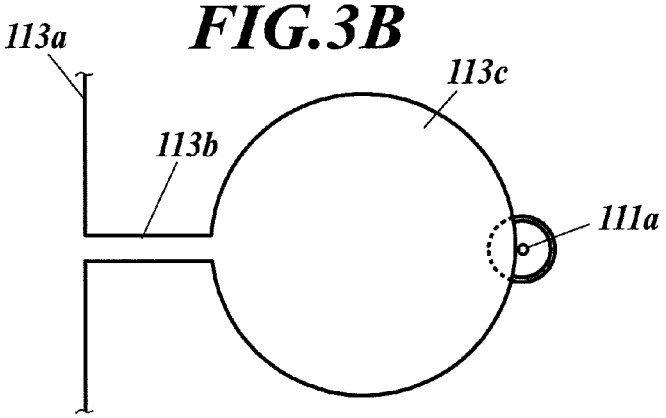
FIG. 3B is a plan view of an ink flow path relating to one nozzle of the head chip.

FIG. 3A is a cross-sectional view illustrating an ink flow path for one nozzle in the head chip 110 of the inkjet head 100 according to this embodiment. The cross-sectional view is taken along a direction orthogonal to the face of the plate head chip 110. FIG. 3B is a plan view illustrating an ink flow path for one nozzle in the head chip 110 of the inkjet head 100.

With reference to FIG. 3A, the head chip 110 discharges ink by a piezoelectric scheme of a deflection mode. The head chip 110 is a laminate of a nozzle plate 111, an intermediate plate 112, and a pressure plate 113.

The nozzle plate 111 is, for example, a silicon substrate having nozzles 111*a* formed in one face. The nozzles 111*a* communicate with respective upper nozzle portions 111*b* and connect two sides of the nozzle plate 111. The actual diameter (nozzle diameter) $\phi$ of the orifice of each of the nozzles 111*a* is sufficiently small to correspond to the resolution. The nozzle diameter $\phi$ in this embodiment is 10 μm or less, for example, 5.0 μm, which significantly enhances the effect of the viscosity and surface tension on the ink inside and extruded from the nozzles 111*a*.

The term "nozzle diameter" refers to the diameter of the orifice at the discharging end of a nozzle, i.e., the diameter of a circular orifice. The shape of the orifice of each of the nozzles is a circle or any other shape, such as polygon or a star. The nozzle diameter of an orifice having a shape other than a circle is defined by the diameter of a circle having an area equal to the area of the shape other than a circle.

The intermediate plate 112 is a glass plate, for example, and is bonded to a face of the nozzle plate 111 remote from the face having the orifices of the nozzles 111*a*, to form a laminate. The intermediate plate 112 has communicating holes 112*a* that communicate with the respective upper nozzle portions 111*b*.

The pressure plate 113 is a silicon plate, for example, and is bonded to a face of the intermediate plate 112 remote from the bonding face where the intermediate plate 112 is bonded to the nozzle plate 111, to form a laminate. A face of the pressure plate 113 has an array of grooves constituting a common flow path 113*a*, inlets 113*b*, and pressure chambers 113*c* for ink, which are in communication with each other. The face is boned to the intermediate plate 112 to cover the grooves to form holes. The pressure chambers 113*c* are connected to the respective communicating holes 112*a* near the end (edge) of the pressure chambers 113*c*.

The face of the pressure plate 113 remote from the bonding face where the pressure plate 113 is bonded to the intermediate plate 112 is provided with piezoelectric members 114 (pressurizing sections) in areas corresponding to the pressure chambers 113*c* and having a shape substantially identical to that of the plan view of the pressure chambers 113*c* with electrode layers (not shown) disposed between the pressure plate 113 and the piezoelectric members 114. The piezoelectric members 114 are composed of PZT (lead zirconate titanate), for example, and are expanded and contracted in response to a predetermined voltage applied across electrode layers disposed on opposite faces of the piezoelectric members 114. The wall between each pressure chamber 113*c* and the corresponding piezoelectric member 114 functions as a diaphragm that deforms together with the piezoelectric member 114 to vary the pressure on the ink in the pressure chamber 113*c*. The variation in pressure is appropriately controlled to discharge ink from the corresponding nozzle 111*a*.

Alternatively, the diaphragm may be bonded between the pressure plate 113 and the piezoelectric members 114 so as to cover the pressure chambers 113*c* extending through the pressure plate 113.

The common flow path 113*a* supplies ink to the nozzles 111*a* in common provided in the head chip 110. The ink is supplied from the common flow path 113*a* through the inlets 113*b* to the pressure chambers 113*c* corresponding to the respective nozzles 111*a*, the inlets 113*b* being in communication with the respective pressure chambers 113*c*.

An inlet 113*b*, pressure chamber 113*c*, communicating hole 112*a*, upper nozzle portion 111*b*, and nozzle 111*a* constitute an ink flow path to each of the nozzles.

With reference to FIGS. 3A and 3B, the dimensions (length in particular) differ among the components constituting each ink flow path, i.e., the inlet 113*b*, pressure chamber 113*c*, communicating hole 112*a*, upper nozzle portion 111*b*, and nozzle 111*a*. Thus, a variation in the pressure on the ink in the pressure chamber 113*c* transmitted to the ink in an ink flow path is partially reflected at the boundary of each component and generates natural oscillations in multiple modes. The frequencies in these modes depend on the dimensions of the components and the properties of the ink.

Figure 4:
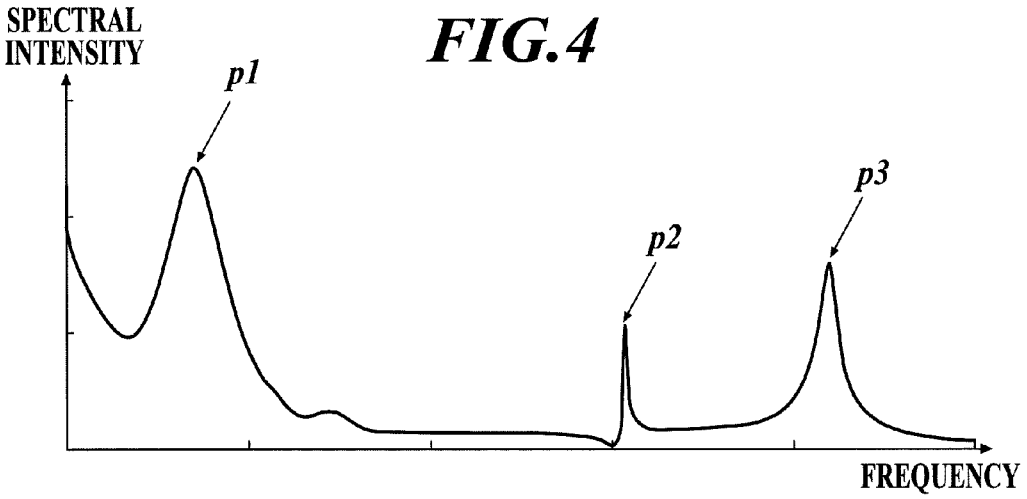
FIG. 4 illustrates example frequency characteristics of the natural oscillation generated in an ink flow path according to an embodiment.

FIG. 4 illustrates example frequency characteristics of the natural oscillation generated in an ink flow path according to this embodiment. The horizontal axis represents frequency, and the vertical axis represents spectral intensity.

Three peaks p1 to p3 appear in the spectral intensity. That is, oscillations in three modes are induced in the ink flow path. The oscillation of the peak p1 having the lowest frequency among the three modes is a first-order mode oscillation depending on the entire structure of the ink flow path including the nozzle 111*a*, the upper nozzle portion 111*b*, the communicating hole 112*a*, the pressure chamber 113*c*, and the inlet 113*b*. The oscillation of the peak p2 having the intermediate frequency depends on the structure including the pressure chamber 113*c* and the inlet 113*b* and corresponds to a noise component unrelated to the discharge of ink from the nozzle 111*a*. The oscillation of the peak p3 having the highest frequency is a second-order mode oscillation depending on the structure including the nozzle 111*a*, the upper nozzle portion 111*b*, the communicating hole 112*a*, and the pressure chamber 113*c* (i.e., part of the ink flow path including the nozzle 111*a*).

The discharging of ink will now be described.

Figure 5A:
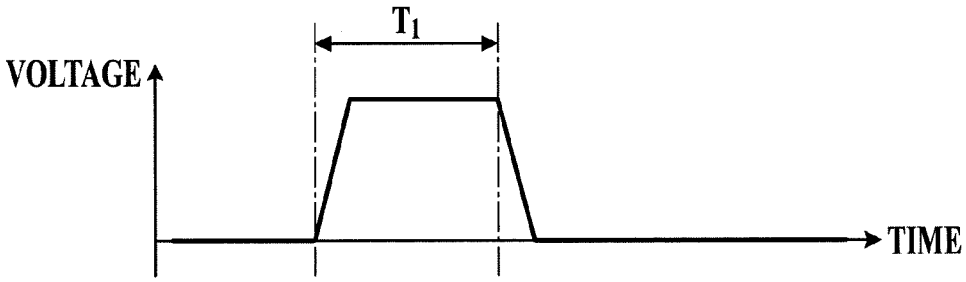
FIG. 5A illustrates a voltage having a pulsed waveform to be applied to a piezoelectric member.
Figure 5B:
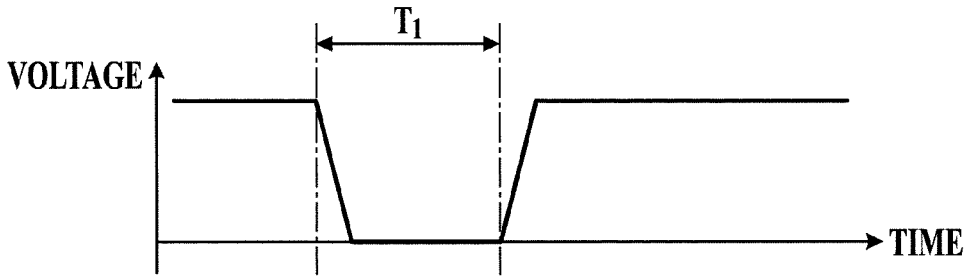
FIG. 5B illustrates a voltage having a pulsed waveform to be applied to a piezoelectric member.
Figure 5C:
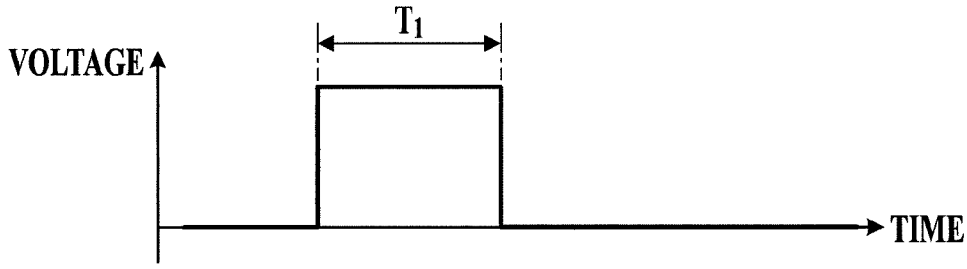
FIG. 5C illustrates a voltage having a pulsed waveform to be applied to a piezoelectric member.

FIGS. 5A to 5C illustrate voltages having pulsed waveforms to be applied to the piezoelectric members 114.

Hereinafter, a positive voltage refers to a voltage that deforms the piezoelectric members 114 and the respective diaphragms in a direction that compresses the respective pressure chambers 113*c* (downward in FIG. 3A).

The waveform of the voltage to be applied to the piezoelectric members 114 correspond to substantial square-wave (trapezoidal) pulses, which have predetermined times for rising and falling edges of the voltage (rising time and falling time). Either a push ejection pulse waveform in which the voltage shifts in the positive pressure direction as illustrated in FIG. 5A, or a pull ejection pulse waveform in which the voltage shifts in the negative pressure direction as illustrated in FIG. 5B is selected. The pulse width T1 (predetermined time) of the pulsed waveform is set to the half cycle of the natural oscillation of the first-order mode. A voltage having a pull ejection pulse waveform applied to the piezoelectric members 114 causes the respective pressure chambers 113*c* to expand and then contract. In contrast, a voltage having a push ejection pulse waveform applied to the piezoelectric members 114 causes the respective pressure chambers 113*c* to contract and then expand.

A pulsed waveform having short rising and falling times of the voltage, such as that illustrated in FIG. 5C, resembles a square wave. The piezoelectric members 114 that receive the square wave voltage oscillates at a frequency whose half cycle is equal to the pulse width T1 and frequencies equal to the integral multiples of this frequency and transmits such oscillation to the respective pressure chambers 113*c*. The amplitude of the oscillation of the pressure applied to the ink at the natural frequency varies depending on the difference between these frequencies and the natural frequency of the first-order mode (first-order mode natural frequency) or the natural frequency of the second-order mode (second-order mode natural frequency). If the frequencies are identical, the oscillation is intensely induced.

Figure 6:
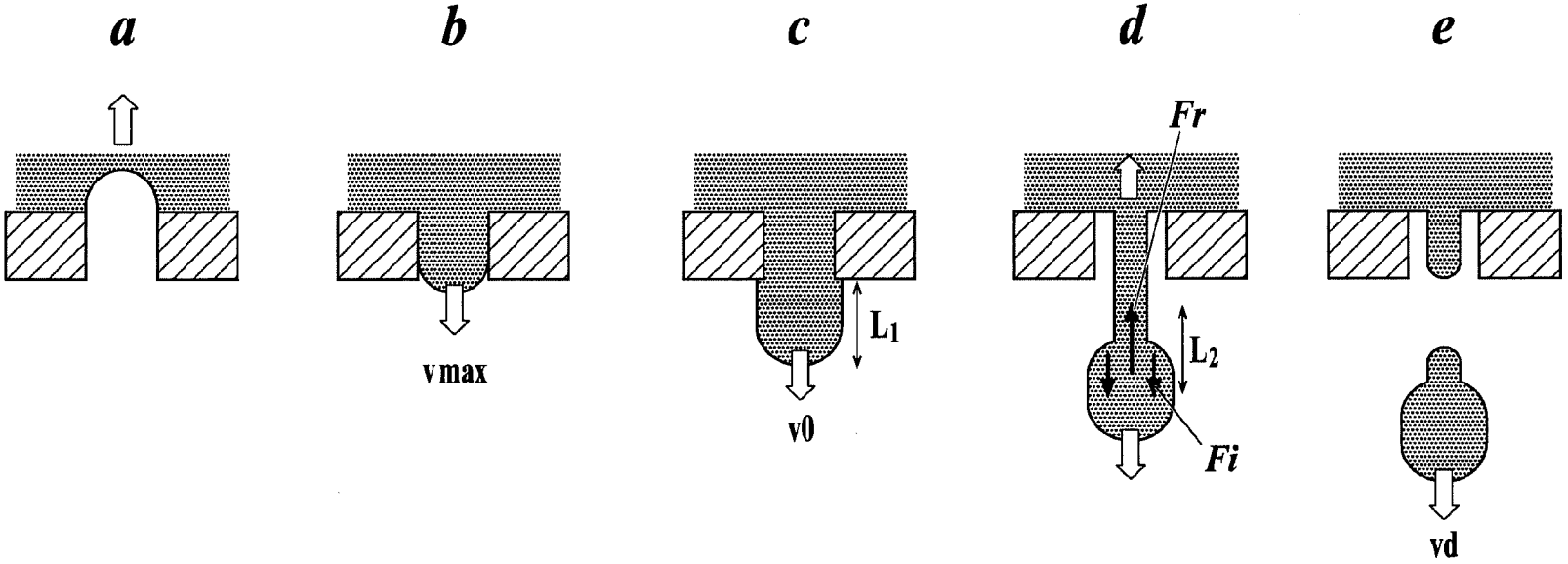
FIG. 6 illustrates the behavior of ink receiving a voltage having a pulsed waveform.

FIG. 6 illustrates the behavior of ink receiving a voltage having a pulsed waveform.

The behavior of ink receiving a voltage having a pull ejection pulse waveform will now be described.

A voltage having a pull ejection pulse waveform applied to a piezoelectric member 114 expands the corresponding pressure chamber 113*c* and lowers the pressure on the ink in the corresponding nozzle 111*a*. The ink is attracted by a force in the direction of the upper nozzle portion 111*b*, and the fluid level shifts inward (FIG. 6*a*). The ink decelerates due to an increase in pressure and the viscous resistance corresponding to the retraction velocity, is then pushed toward the tip of the nozzle 111*a*, and is extruded from the tip (orifice) of the nozzle 111*a* at a maximum moving velocity vmax (FIG. 6*b*).

The ink extruded from the orifice of the nozzle 111*a* to a length $L_1$ corresponding to the variation in the pressure on the ink (FIG. 6*c*) undergoes viscous resistance Fr that interferes with the discharge of ink from the orifice of the nozzle 111*a* (FIG. 6*d*). If a force Fi equivalent to the inertial force of the ink discharged from the orifice of the nozzle 111*a* to keep moving (equivalent to the energy received by the ink during extrusion) is larger than the viscous resistance Fr (equivalent to the energy consumed by the viscosity), the extruded ink separates from the remaining ink being retracted into the ink flow path and is discharged as a droplet at a velocity vd smaller than the maximum moving velocity vmax (FIG. 6*e*).

Whether the ink extruded from the orifice of the nozzle 111*a* is to separate from the ink in the ink flow path and to be discharged as a droplet can be approximately calculated from the force Fi received by the ink during extrusion from the nozzle 111*a* and the viscous resistance Fr on the retraction of the ink, in disregard of other forces such as surface tension.

The shearing stress $\tau$ associated with the viscous resistance Fr is defined by $\tau=\eta\cdot dv/dy$, where y is the in-plane direction orthogonal to the nozzle axis of the nozzle 111*a*, *v* is the moving velocity of the fluid level of the ink in the direction of the nozzle axis, and $\eta$ is the viscosity of the ink (coefficient of viscosity). The shearing stress $\tau$ can be approximated to the laminar flow velocity in the nozzle 111*a* and defined by $\tau=\eta\cdot(v/(\phi/4))$.

A column of ink that is to be separated (by a shearing force) from the tip of the nozzle 111*a* as a droplet can be approximated to a column having a front surface area $S_2$ defined by $S_2=\pi\phi L_2$, where $L_2$ is the length of the column of ink. The shearing stress $\tau$ refers to the force of viscous resistance Fr per unit area and is defined by $\tau=Fr/S_2$ or $\tau=Fr/(\pi\phi L_2)$.

From these expressions, the viscous resistance Fr is defined by $Fr=4\pi L_2\eta v$. Thus, the coefficient of viscous resistance R, which is a coefficient proportional to the velocity v, is defined by $R=4\pi L_2\eta$.

The force Fi received by the ink extruded from the nozzle 111*a* is defined by $Fi=M\omega v$, where M is the mass of the extruded ink, $\omega$ is the angular velocity of the natural oscillation on the extrusion of the ink, and v is the velocity. The mass M is defined by $M=\pi\rho(\phi/2)^2L_1$, where $\rho$ is the density of the ink and $L_1$ is the length of the column of ink extruded from the tip of the nozzle 111*a*. The force Fi is defined by $Fi=2\pi^2 f\rho v(\phi/2)^2L_1$, where f is the natural frequency.

The ratio $Fi/Fr=M\omega/R$ of the force Fi to the viscous resistance Fr determined above defines a Q value serving as an index for the intensity of resonance. The Q value is defined by $Q=(L_1/L_2)\pi f\rho\phi^2/(8\eta)$. Given that $L_1=L_2$, $Q=\pi f\rho\phi^2/(8\eta)$. The Q value of 1 or more indicates that the ink extruded from the nozzle 111*a* can be separated from the ink in the ink flow path and discharged as a droplet.

In this inkjet head 100, combinations of the dimensions of the components of the head chip 110 and the viscosity $\eta$ of the ink are selected that satisfy the conditions for the Q value and reduce the volume of ink $M/\rho$ (predetermined volume of ink) discharged from a nozzle 111*a* per driving pulse. Specifically, the volume of ink discharged per driving pulse is smaller than 1 pl, preferably 0.1 pl or less.

A decreased nozzle diameter $\phi$ and an increased natural frequency f can separate and discharge droplets having small dimensions (volumes) without a decrease in the Q value.

A decrease in viscosity $\eta$ and an increase in the applied voltage that leads to an increase in the degree of deformation of the pressure chambers 113*c* both increase the maximum moving velocity vmax of the fluid level and the variable amplitude of the fluid level $L_1$. Thus, the decrease in viscosity $\eta$ and the increase in the applied voltage increase the dimensions of the discharged droplets. If either the viscosity $\eta$ or the voltage is to be increased or decreased, the other should also be increased or decreased in conjunction within a possible range.

An example calculation will now be described on the discharge of the ink from a head chip 110 satisfying the conditions described above.

FIG. 7 is a table showing the dimensions of the components of the head chip 110 used for the calculation.

The head chip 110 has a structure (setting 1) that oscillates in three natural frequencies: 120 kHz (first-order mode), 616 kHz (noise), and 816 kHz (second-order mode). A large length of the inlets 113*b* compared to that of other components increases the difference between the frequencies in the first-order mode and second-order mode. The parameter d31 of the piezoelectric members 114 is a piezoelectric constant (pm/V) in the contracting direction.

Figure 8:
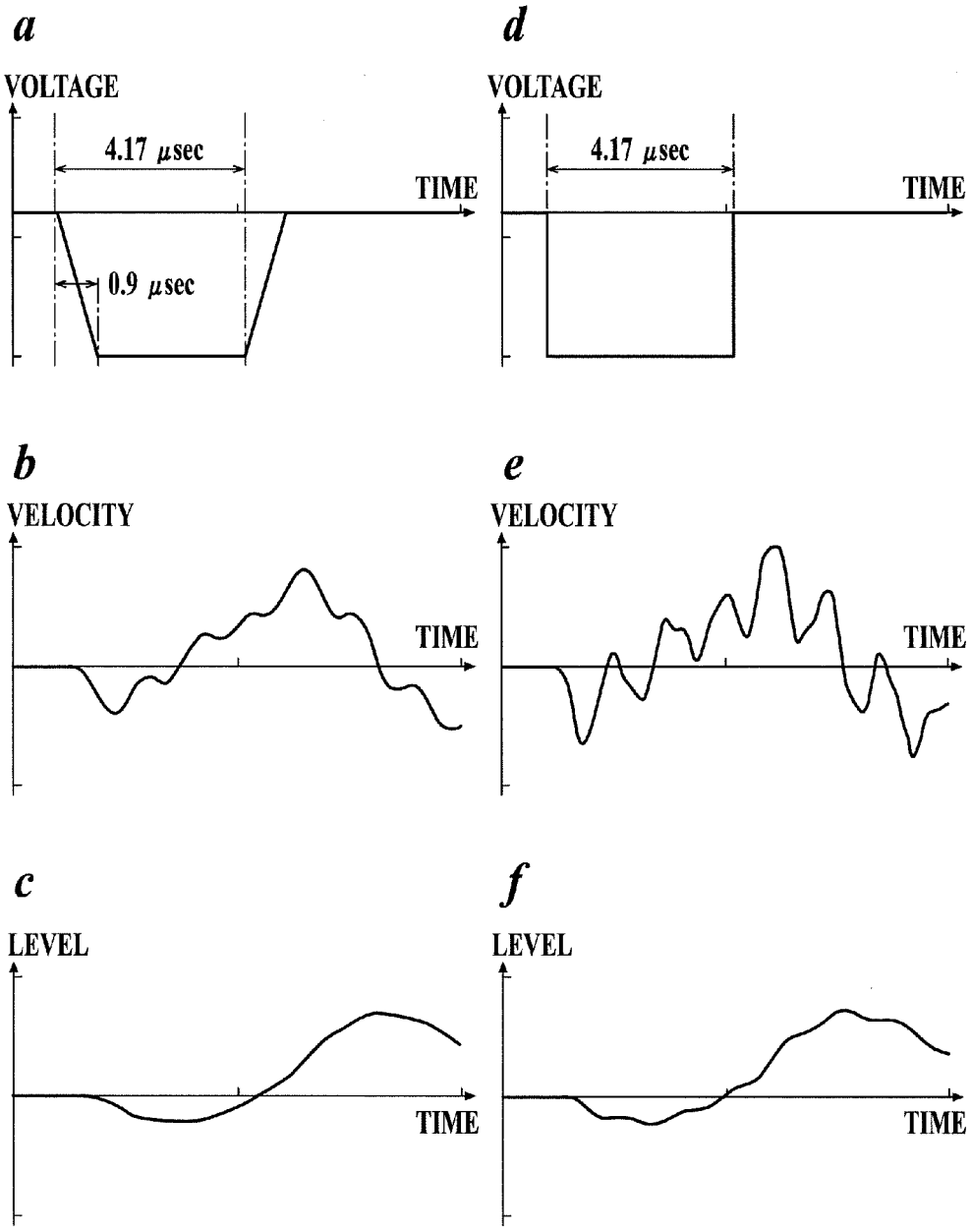
FIG. 8 illustrates an example calculation of the moving velocity and the fluid level of ink during application of a voltage having a pull ejection pulse waveform corresponding to a first-order mode, to a piezoelectric member.
Figure 9:
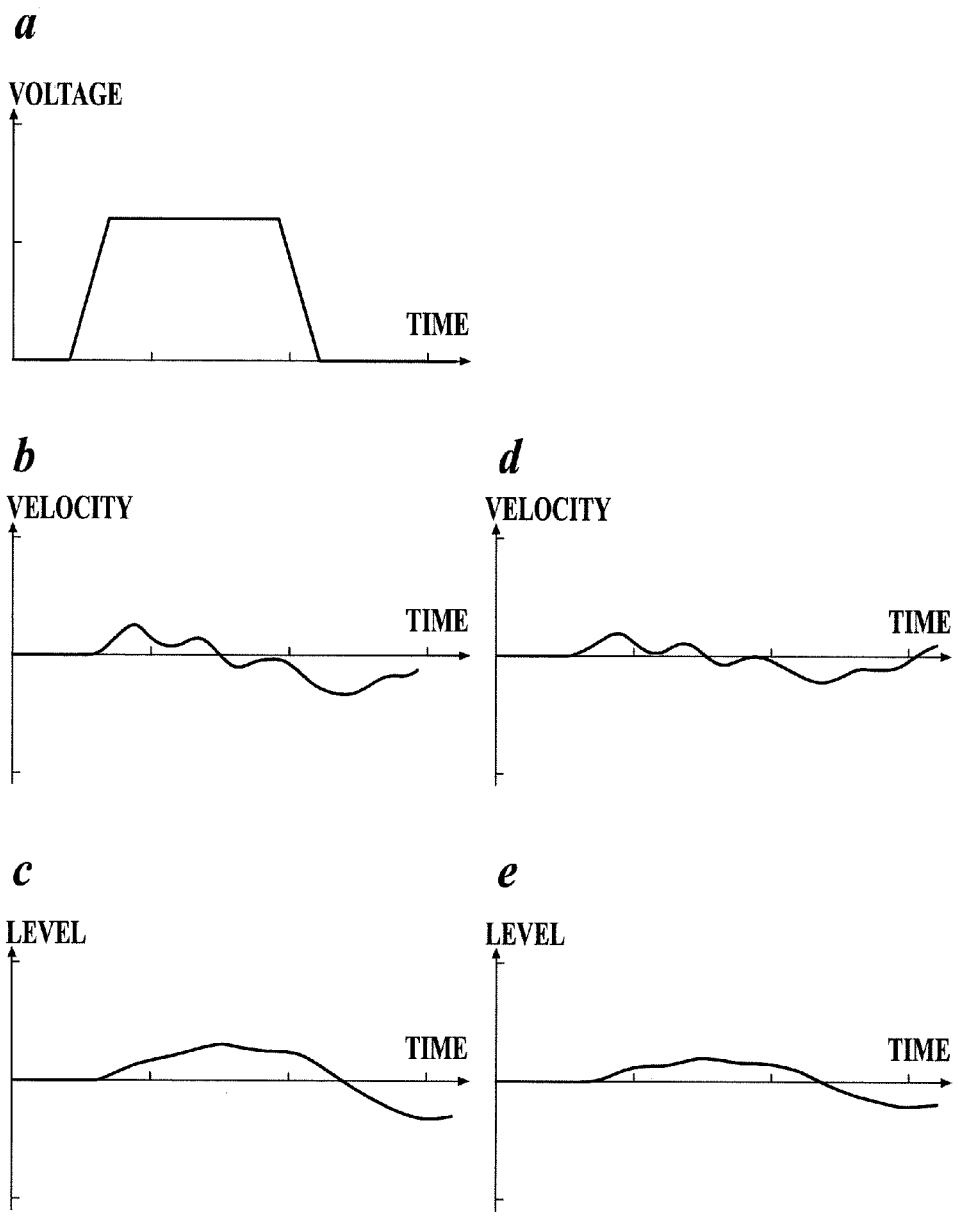
FIG. 9 illustrates an example calculation of the moving velocity and the fluid level of ink during application of a voltage having a push ejection pulse waveform corresponding to a first-order mode, to a piezoelectric member.

FIGS. 8 and 9 illustrate example calculations of the moving velocity and the fluid level of ink in the head chip 110 having the dimensions mentioned above during application of a voltage having a pulsed waveform of which the length corresponds to the cycle of the natural oscillation of the first-order mode. The moving velocity and fluid level are calculated for ink having a density ρ of 980 kg/m$^3$ and a viscosity η of 3 mPa·s (3 cp) during a variation in pressure due to deformation of a pressure chamber 113*c*. The graphs represent a qualitative difference in natures and thus the vertical axis does not represent actual numerical values.

With reference to FIG. 8*a*, a voltage is applied that has a pull ejection pulse waveform, rising and falling times of 0.9 μs, and a pulse width of T=4.17 μs, which is the length of the half cycle of the first-order mode natural oscillation of 120 kHz. With reference to FIG. 8*c*, the fluid level (meniscus) of the ink shifts inward and then outward from the orifice plane of the nozzle 111*a*. With reference to FIG. 8*b*, the moving velocity of the fluid level of the ink near the nozzle 111*a* varies in accordance with the cycle of the first-order mode natural oscillation and is superposed with the variation due to the second-order mode natural oscillation, which has a shorter cycle than the first-order mode natural oscillation. If the variations are in phase, the amplitude increases; whereas if opposite in phase, the amplitude is cancelled out.

For ink having the above mentioned density ρ, viscosity η, and nozzle diameter ϕ, the Q value of the natural frequency of the first-order mode is less than 1 (Q=0.38), and the Q value of the natural frequency of the second-order mode is greater than 1 (Q=2.62). Thus, the natural oscillation of the first-order mode alone cannot separate or discharge the ink as droplets.

In this example, the natural oscillation of the second-order mode is not induced enough. So, the application of the voltage having a pulsed waveform relating to the natural oscillation of the first-order mode does not discharge ink with the natural oscillation of the second-order mode. With reference to FIG. 8*d*, a voltage having a pull ejection pulse waveform is applied with a square waveform having negligibly small rising and falling times and a pulse width of T=4.17 μs. With reference to FIG. 8*f*, the fluid level of the ink shifts inward and then outward from the orifice plane of the nozzle 111*a* in accordance with the natural oscillation of the first-order mode, with more intense fine fluctuations compared to the example illustrated in FIG. 8*c*. With reference to FIG. 8*e*, the moving velocity of the fluid level of the ink is obtained by superposing the variation due to the second-order mode natural oscillation on the variation on the cycle of the first-order mode natural oscillation, with the variation due to the second-order mode natural oscillation having a larger amplitude than that of the first-order mode natural oscillation. That is, the ink is intensely accelerated at timings in accordance with the cycles of the second-order mode natural oscillation. The ink is separated and discharged in the form of droplets by the natural oscillation of the second-order mode. A discharged droplet is often preceded and/or followed by other droplets (satellites).

Such results indicate that ink droplets cannot be separated and discharged by the superposition of the amplitude of the natural oscillation of the second-order mode if the amplitude of the natural oscillation of the second-order mode is smaller than the amplitude of the natural oscillation of the first-order mode. In contrast, if the amplitude of the natural oscillation of the second-order mode is larger than the amplitude of the natural oscillation of the first-order mode, ink droplets are separated multiple times at each cycle of the natural oscillation of the second-order mode to form satellites. The atomized satellites moving at a velocity significantly smaller than that of the main droplet will undesirably fly around the nozzle and land at unintended sites in some cases. Thus, the lengths of the rising and falling times should be appropriately selected to establish an appropriate value for the ratio of the amplitude of the natural oscillation of the second-order mode to the amplitude of the natural oscillation of the first-order mode. Specifically, it is preferred that the rising time of the pulsed voltage be smaller than the cycle time of the natural oscillation of the second-order mode (which in this case is 1.23 μs). This efficiently induces the second-order mode natural oscillation.

A decrease in the viscosity η (to 1.0 mPa·s, for example) leads to a Q value of 1 or more for the natural oscillation of the first-order mode. In such a case, the amplitudes can be appropriately cancelled out by the natural oscillation of the second-order mode to reduce the volume of the ink to be discharged.

FIG. 9 illustrates the calculated results of the moving velocity and the fluid level of ink during application of a voltage having a push ejection pulse waveform. With reference to FIG. 9*a*, a pulse with a voltage of 39.4 V having rising and falling times of 0.7 μs and a width of 3.8 μs (frequency of 132 kHz) is applied to a piezoelectric member 114. With reference to FIG. 9*c*, the fluid level of the ink shifts outward and then inward from the orifice plane of the nozzle 111*a*. With reference to FIG. 9*b*, the variation due to the natural oscillation of the second-order mode is superposed on the variation on the cycle of the natural oscillation of the first-order mode, to appear in the moving velocity of the fluid level of the ink. The amplitude and the moving velocity reach a peak during the first cycle of the second-order mode natural oscillation, and an ink droplet is separated and discharged. The volume of the discharged ink can be reduced to 0.20 pl.

FIGS. 9*d* and 9*e* illustrate example calculations at an applied pulsed voltage of 58.0 V having a push ejection pulse waveform and ink having viscosity η of 5 mPa·s. The other conditions are the same as those in FIGS. 9*a* to 9*c*.

A decrease in the Q value (which is 1.57) due to an increased viscosity η precludes the separation of the ink into droplets, as described above. At a force Fi larger than the viscous resistance Fr, an increased applied voltage can increase the oscillation of the fluid level of the ink to readily discharge ink droplets. The moving velocity of the fluid level of the ink illustrated in FIG. 9*d* is similar to that illustrated in FIG. 9*b*, and the variation in the fluid level of the ink illustrated in FIG. 9*e* is similar to that illustrated in FIG. 9*c*. The volume of the discharged ink is 0.21 pl.

With reference to FIG. 9, the Q value of the natural oscillation of the first-order mode is less than 1, and the Q value of the natural oscillation of the second-order mode is 1 or more. Appropriate separation and discharge of the ink by the natural oscillation of the second-order mode is achieved through a slight shift in the duration of application of the pulsed voltage from the half cycle of the natural oscillation of the first-order mode and a slight reduction in the rising and falling times of the pulsed voltage compared to those illustrated in FIG. 8*a*. That is, the pulse width can be appropriately shifted within a range corresponding to the natural frequency of the first-order mode (for example, closer to this natural frequency than harmonic waves or other natural frequencies). Such fine adjustment effectively induces the natural oscillation of the second-order mode to discharge minute volumes of ink corresponding to the natural oscillation of the second-order mode during application of a voltage having a waveform of the natural frequency of the first-order mode.

The difference between the application of a voltage having a push ejection pulse waveform and a voltage having a pull ejection pulse waveform will now be described in detail.

Figure 10:
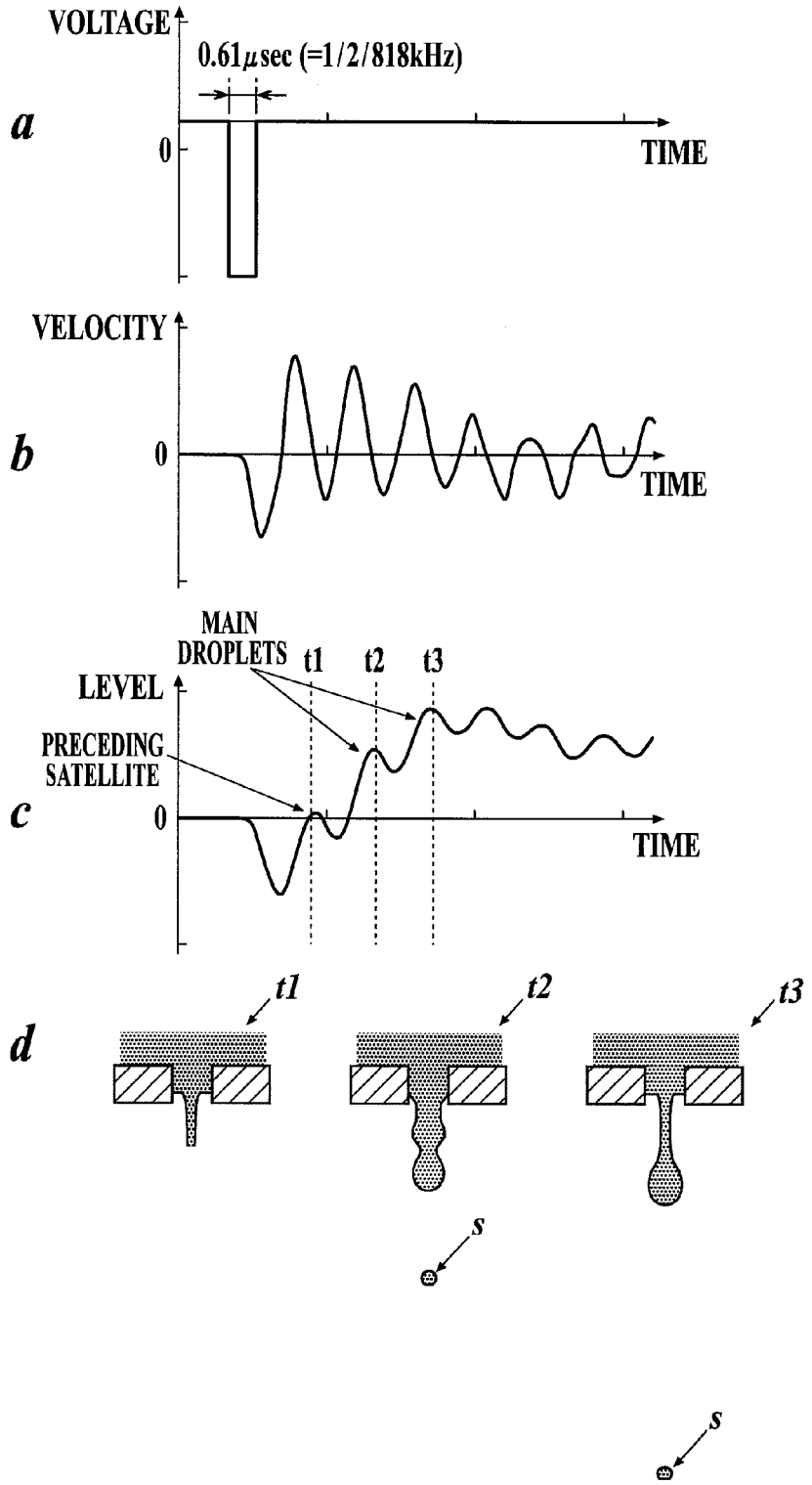
FIG. 10 illustrates discharge of ink droplets when natural oscillation of a second-order mode occurs in the pressure chambers by application of a voltage having a pull ejection pulse waveform.

FIG. 10 illustrates discharge of ink droplets when natural oscillation of the second-order mode is induced in the ink by application of a voltage having a pull ejection pulse waveform. FIG. 10*a* illustrates the calculated result of the behavior of ink having a viscosity η of 3 mPa·s and a density ρ of 980 kg/m$^3$ during application of a negative driving pulse voltage of 36 V at a cycle of 0.61 μs ((1/818/2) kHz), which is equal to half the cycle of the natural oscillation of the second-order mode in setting 1.

With reference to the fluid level illustrated in FIG. 10*c*, the application of a voltage having a pull ejection pulse waveform causes the fluid level of the ink to shift inward from the discharge plane of the nozzle toward the upper nozzle portion 111*b*. Ink is then discharged in response to the oscillation of the fluid level of the ink. With reference to the moving velocity of the fluid level illustrated in FIG. 10*b*, the oscillation of the fluid level due to application of a voltage having a pull ejection pulse waveform often remains without attenuation (reverberant oscillation) and extrudes the ink multiple times (timings t1 to t3).

The application of a voltage having a pull ejection pulse waveform causes ink droplets to separate during the multiple times of extrusion and thus precludes stable control of the flying velocity of the discharged ink droplets. As illustrated in the schematic view in FIG. 10*d*, satellites s are often formed before and after discharge of the main ink droplets at these peaks. An increase in the applied voltage (for example, 39 V) causes splitting of an ink droplet that has been separated into two droplets before discharge. The oscillation superposed with the oscillation in the first-order mode of a voltage having a pulsed waveform in the next cycle causes oscillations in multiple phases to be mixed and cancelled out. This may preclude continuous discharge of ink.

Figure 11:
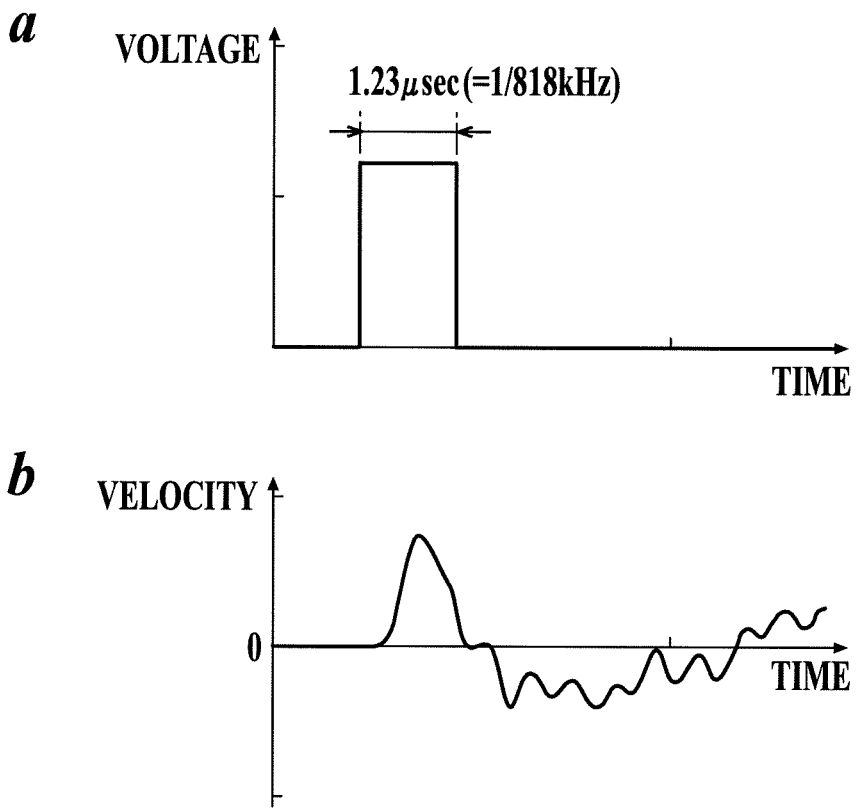
FIG. 11 illustrates discharge of ink droplets when natural oscillation of a second-order mode occurs in the pressure chambers by application of a voltage having a push ejection pulse waveform.

FIG. 11 illustrates the discharge of ink droplets when the natural oscillation of the second-order mode is induced in the ink by a voltage having a push ejection pulse waveform applied to a pressure chamber 113*c*. FIG. 11*a* illustrates the calculated result of the behavior of ink having a viscosity of 3 mPa·s and a density of 980 kg/m$^3$ during application of a positive pressure driving pulse voltage of 30 V having rising and falling times of 0.05 μS at a cycle of 1.23 μs (1/818 kHz), which is equal to the cycle of the natural oscillation of the second-order mode in setting 1, to a piezoelectric member 114.

The application of a voltage having a push ejection pulse waveform causes the ink to be extruded at a high extrusion velocity and discharged at the beginning of the oscillation in the second-order mode. That is, ink can be efficiently discharged at the first peak of the moving velocity of the fluid level through the application of a voltage having a push ejection pulse waveform. The volume of the ink droplet is 0.10 pl. With reference to FIG. 11*b*, the oscillation of the fluid level caused by the application of the voltage having a push ejection pulse waveform attenuates faster than the oscillation caused by the application of a voltage having a pull ejection pulse waveform. As a result, the application of the voltage having a push ejection pulse waveform causes ink to be discretely discharged once at the beginning of each application of oscillation in the first-order mode without reverberant oscillation causing noise. This enables stable continuous discharge without the formation of satellites and an adverse effect on the continuous discharge.

A ratio of the second-order mode natural frequency to the first-order mode natural frequency that is larger than or equal to a predetermined value can reduce the shift of the fluid level of the ink by the first-order mode natural oscillation during the cycles of the second-order mode natural oscillation. Specifically, the natural frequency of the second-order mode that is at least four times higher than the natural frequency of the first-order mode can reduce the displacement by the natural oscillation of the first-order mode to one-half or less of the amplitude of the natural oscillation of the first-order mode during the first cycle of the second-order mode natural oscillation induced by the application of a voltage having a push ejection pulse waveform. Thus, the ink can be discharged dye to the shift of the fluid level by the natural oscillation of the second-order mode, without the undesirable influence of the shift of the fluid level by the natural oscillation of the first-order mode.

A positive or negative change in the voltage having a push ejection pulse waveform can vary the flying velocity and the volume of the droplets while maintaining stable discharge of ink. For example, a decrease of applied voltage to 27 V decreases the flying velocity to 1 to 2 m/s and the volume of the droplets to 0.09 pl, whereas an increase of applied voltage to 36 V increases the flying velocity to 6 m/s and the volume of the droplets to 0.13 pl.

Ink having a viscosity η of 5 mPa·s can be stably discharged as droplets each having a volume of 0.10 pl by increasing the voltage having a pulsed waveform to 42 V.

As described above, the ink droplets discharged in response to application of a voltage having a push ejection pulse waveform can be stably separated and discharged under conditions broader than those for the ink droplets discharged in response to application of a voltage having a pull ejection pulse waveform.

FIG. 12 is a table showing the influence of the length of a second-order mode path on the discharge of droplets of ink when the natural oscillation of the second-order mode is induced to the ink by the application of a voltage having a push ejection pulse waveform.

As described above, the natural oscillation of the second-order mode depends on the structure of the pressure chambers 113*c* and the nozzles. In the case of components having identical shapes, the natural frequency decreases as the total length of the components increases. Specifically, an increase in the lengths of the communicating holes 112*a* and the upper nozzle portions 111*b* from those in setting 1 (settings 2 and 3) lowers the natural frequency of the second-order mode. As a result, the variation in the moving velocity of the fluid level decreases and the volume of the droplets discharged during one driving pulse increases. The variation in the volume is gradual compared to the variation in the natural frequency of the second-order mode. Thus, the dimensions of the pressure chambers 113*c* and nozzles can be selected from a wide range.

FIG. 13 is a table showing the influence of the length of the inlets 113*b* on the discharge of ink droplets when the natural oscillation of the second-order mode is induced in the ink by the application of a voltage having a push ejection pulse waveform.

As described above, the length of the inlets 113*b* affects the natural frequency of the first-order mode and the natural frequency of noise. Settings 4 to 7 do not exhibit any characteristic variation in the natural frequency of the second-order mode compared with that in the setting 1. In this case, the variation in the volume of each droplet discharged during one driving pulse is insignificant.

Short inlets 113*b* cause less distinctiveness between the structure on which the natural oscillation of the first-order mode depends and the structure on which the natural oscillation of the second-order mode depends. The natural frequency of the first-order mode increases to approximate the natural frequency of the second-order mode. As a result, the applied driving pulses induce the natural oscillation of the first-order mode as well. Thus, the moving velocity of the fluid level associated with the discharge of ink cannot be represented by a waveform having a single peak, but one or more peaks following the preceding peak (reverberant oscillation). This could increase the number of satellites.

The length of the inlets 113*b* does not have a significant influence on the discharge of ink by the natural oscillation of the second-order mode and thus should be appropriately determined based on the settings for the natural frequency of the first-order mode. As described above, each of the ink flow paths can be designed to have a natural frequency of the second-order mode that is at least approximately four times higher than a natural frequency of the first-order mode, for stable and ready discharge of minute droplets.

FIG. 14 is a table showing the influence of the diameter of the nozzles 111*a* on the discharge of droplets of ink when the natural oscillation of the second-order mode is induced in the ink by the application of a voltage having a push ejection pulse waveform.

The nozzle diameters in the settings 8 and 9 are different from the nozzle diameter 5.0 μm in the setting 1. Such a slight difference (which is 4% in this case) in the nozzle diameters ϕ does not have any significant influence on the natural frequency of the second-order mode and the volume of the discharged ink. Thus, the nozzle diameter can be set to any appropriate value corresponding to the Q value and other parameters.

As described above, the inkjet head 100 according to this embodiment includes ink flow paths each including a nozzle 111*a* and a pressure chamber 113*c* in communication with the nozzle 111*a* so that the ink flow path allows ink from an ink chamber 122 to be supplied to the nozzle 111*a*; and piezoelectric members 114 to vary the pressure on the ink in the pressure chambers 113*c* via diaphragms. Each of the ink flow paths has a natural frequency of a first-order mode depending on a combination of the entire structure of the ink flow path and the properties of the ink, and has a natural frequency of a second-order mode, which is higher than the natural frequency of the first-order mode, depending on a combination of a part of the structure of the ink flow path including the nozzle 111*a* and the properties of the ink. The piezoelectric members 114 deform in response to a voltage applied to the piezoelectric members 114 to vary the pressure on the ink for a predetermined time corresponding to the natural frequency of the first-order mode, so that a predetermined volume of the ink is discharged at at least one of times when a shift of an ink level due to pressure oscillation of the ink at the natural frequency of the second-order mode is superposed on a shift of an ink level due to pressure oscillation of the ink at the natural frequency of the first-order mode.

Thus, the inkjet head 100 can reduce the volume of the ink to be discharged to a minute value associated with the second-order mode natural frequency through application of voltage pulses having a frequency not significantly different from that applied in a conventional inkjet head. The applied voltage can be varied in accordance with the viscosity of the ink without electrostatic attraction. This reduces the restrictions on the type of ink applicable for discharge of minute ink droplets.

The ink is discharged by a voltage having a push ejection pulse waveform, which shifts the voltage to be applied to the piezoelectric members 114 in the positive direction; thus, the ink is certainly discharged at the first pressurization by the second-order mode natural oscillation. Furthermore, since the second-order mode natural oscillation induced by a voltage having a push ejection pulse waveform attenuates in a short time, the formation of satellites and the adverse effect of reverberant oscillation on continuous discharge can be prevented.

The ink cannot be discharged by the first-order mode natural oscillation alone; thus, a small volume of ink can be efficiently and stably discharged in accordance with the second-order mode natural oscillation.

The structure of each ink flow path and the properties of the ink are appropriately determined in such a way that a Q value relating to the pressure oscillation of the ink at the first-order mode natural frequency is less than 1; in this way, a minute volume of ink can be appropriately discharged in a short time only at a time when the shift of the fluid level in the discharge direction of the ink due to the second-order mode natural oscillation and the shift of the fluid level of the ink due to the first-order mode natural oscillation are superposed without cancelling each other out.

Each of the ink flow paths has a natural frequency of the second-order mode that is at least four times higher than a natural frequency of the first-order mode; this prevents the adverse effect of the shift of the fluid level by the natural oscillation of the first-order mode and achieves stable discharge of ink based on the shift of the fluid level by the natural oscillation of the second-order mode.

Pressurization of ink by applying, to the piezoelectric members 114, a voltage having a substantially square waveform with rising and falling times each shorter than a single cycle of the second-order mode natural frequency efficiently induces oscillation of the ink at the second-order mode natural frequency and can discharge ink in accordance with the natural oscillation of the second-order mode. Thus, minute volumes of ink droplets can be efficiently discharged.

The pressure chambers 113*c* deform as a result of a voltage applied to the piezoelectric members 114 and vary the pressure on the ink; thus, compact pressure chambers 113*c* can efficiently apply a predetermined pressure to the ink with a satisfactory response.

The inkjet recording device 10 according to this embodiment includes an inkjet head 100 and a control section 200, the control section 200 applying voltage to the piezoelectric members 114 in every predetermined cycle for ink discharge to vary the pressure inside the pressure chambers 113*c*. That is, the inkjet recording device 10 can readily apply a voltage corresponding to a natural frequency of the first-order mode appropriately determined in accordance with the properties of the ink; thus, droplets of a minute volume can be discharged without an increase in the size, complicated drive control, and severe restriction, such as limiting the applicable ink to ones that are electrostatically attracted.

The embodiments described above should not be construed to limit the present invention and can include various modifications.

For example, in the embodiment described above, the pressure chambers 113*c* apply pressure to the ink through deformation in a deflection mode by the piezoelectric members 114 and diaphragms. Alternatively, pressure may be applied to the ink through any other scheme that induces natural oscillations in multiple modes.

In the structure according to the embodiment described above, natural oscillations in the first-order mode and second-order mode occur depending on the presence of the inlets 113*b* provided between the pressure chambers 113*c* and the common flow path 113*a* in a common plate. Any other structure is also available. If further layers are provided in a laminate and the common flow path 113*a* and the pressure chambers 113*c* communicate with each other through these layers, through-holes and communicating holes provided in these layers affect the natural frequency of the first-order mode.

An ink flow path having a complicated structure may have natural oscillation in a third-order mode or natural oscillations of other noise. It is preferred that each ink flow path be designed and the pulse waveform of the voltage to be applied be determined to minimize the induction of natural oscillation having a frequency in a range inappropriate for ink discharge. If the natural oscillation of the third-order mode has a frequency within a range applicable to the discharge of ink, this natural frequency can be applied to the present invention to discharge ink through adjustment of the amplitude and phase of the second-order mode, as in the embodiments described above.

Satellite droplets may be present in the case where the volume and landing positions thereof can be appropriately controlled.

In the case of application of a voltage having a pull ejection pulse waveform, the phase of the first-order mode natural oscillation between cycles of the second-order mode natural oscillation associated with the discharge of main droplets varies depending on the ratio of the second-order mode natural frequency to the first-order mode natural frequency (frequency ratio). The amplitude of the second-order mode natural oscillation associated with the discharge of the main droplets also varies in accordance with attenuation. Thus, it is preferred that the frequency ratio be 4:1 or larger.

In the embodiments described above, the effect of surface tension is disregarded. Alternatively, the natural oscillation of the second-order mode can be appropriately determined in consideration of surface tension.

The inkjet recording device according to the present invention may include a line head or a serial head and the type and size of a recording medium on which an image is to be formed may be determined as appropriate. The detailed configuration, structures, processes, and numerical values according to the embodiments described above may be modified in various ways without departing from the scope of the invention.

[Example]

An example of the present invention will now be described in detail. These examples should not be construed to limit the present invention.

[Production of Head Chip]

A head chip including ink flow paths including 128 nozzles each having a diameter of 5.5 μm and natural frequencies of 120 kHz in a first-order mode and 816 kHz in a second-order mode was produced based on the parameters in FIG. 7.

[Results of Operation]

A voltage having a push ejection pulse waveform, a driving pulse width of 4.1 μs in the first-order mode, and rising and falling times of 0.9 μs was applied to piezoelectric members, to discharge ink. A dummy ink having a viscous resistance of 3 mPa·s, a surface tension of $3.0\times10^{-2}$ N/m, and a density of $9.80\times10^{2}$ kg/m$^3$ was supplied to the ink flow paths. Images of the ink discharged from the nozzles were intermittently captured by a drop watcher and observed.

As a result, stable flying of a droplet of 0.1 pl from each nozzle at a droplet velocity of 4.5 m/s was confirmed every time a voltage of 34 V having a pulsed waveform was applied.

Subsequently, a voltage having a pull ejection pulse waveform with a driving pulse width of 4.1 μs and rising and falling times of 0.9 μs was applied to the piezoelectric members, to discharge ink.

As a result, discharge of a droplet having a volume of 0.1 pl was confirmed during application of a voltage of 34 V having a pulsed waveform. Continuous discharge was discovered to cause atomization at each nozzle, shifts in the landing position, and/or misdischarge.

INDUSTRIAL APPLICABILITY

The present invention can be applied to an inkjet head and an inkjet recording device.

REFERENCE NUMERALS

10 inkjet recording device
100 inkjet head
110 head chip
111 nozzle plate
111*a* nozzle
111*b* upper nozzle portion
112 intermediate plate
112*a* communicating hole
113 pressure plate
113*a* common flow path
113*b* inlet
113*c* pressure chamber
114 piezoelectric member
120 ink supply section
121 casing
122 ink chamber
123 ink supply port
130 frame
131 projection
132 hole
200 control section
300 conveying section
400 communication section
500 operation display section

The invention claimed is:

1. An inkjet head comprising:

ink flow paths each including a nozzle from which ink is to be discharged, and a pressure chamber in communication with the nozzle, the ink flow path allowing the ink from an ink chamber to be supplied to the nozzle; and pressurizing sections to vary pressure on the ink in the respective pressure chambers, wherein each of the ink flow paths has a natural frequency of a first-order mode depending on a combination of the entire ink flow path and the ink and has a natural frequency of a second-order mode depending on a combination of a part of the ink flow path and the ink, wherein the part includes the nozzle and wherein the natural frequency of the second-order mode is higher than the natural frequency of the first-order mode; and each of the pressurizing sections varies the pressure on the ink for a predetermined time corresponding to the natural frequency of the first-order mode, so that a predetermined volume of the ink is discharged at at least one of times when a shift of a fluid level of the ink due to pressure oscillation of the ink at the natural frequency of the second-order mode is superposed on a shift of a fluid level of the ink due to pressure oscillation of the ink at the natural frequency of the first-order mode.

2. The inkjet head according to claim 1, wherein the pressurizing sections keep the pressure on the ink in an increased state for the predetermined time.

3. The inkjet head according to claim 1, wherein the nozzles included in the respective ink flow paths each have such a diameter that prevents the ink from being discharged by the shift of the fluid level of the ink due to the pressure oscillation of the ink at the natural frequency of the first-order mode alone.

4. The inkjet head according to claim 1, wherein a Q value relating to the pressure oscillation of the ink at the natural frequency of the first-order mode is less than 1.

5. The inkjet head according to claim 1, wherein the natural frequency of the second-order mode of each of the ink flow paths is at least four times higher than the natural frequency of the first-order mode of each of the ink flow paths.

6. The inkjet head according to claim 1, wherein a variation in the pressure on the ink produced by each of the pressurizing sections is in a form of a substantially square wave pulse having a rising time and a falling time each shorter than one cycle of the natural frequency of the second-order mode.

7. The inkjet head according to claim 1, wherein the pressurizing sections each include a piezoelectric member, wherein the piezoelectric member is deformed in response to a voltage applied to the piezoelectric member, thereby varying the pressure on the ink.

8. An inkjet recording device comprising:

the inkjet head according to claim 1; and a control section that controls an operation of the inkjet head, wherein the control section operates the pressurizing sections at predetermined intervals for ink discharge to vary the pressure on the ink in the respective pressure chambers in communication with the respective nozzles from which the ink is to be discharged.

9. The inkjet head according to claim 1, further comprising a common flow path to supply the ink to the nozzles in common, wherein each of the ink flow paths includes an inlet in communication with the pressure chamber, wherein the ink is supplied from the common flow path through the inlet to the pressure chamber corresponding to the nozzle.

10. The inkjet head according to claim 1, wherein a shape of an orifice of each of the nozzles is a circle.

* * * * *